US011257408B2

(12) United States Patent
Liu

(10) Patent No.: US 11,257,408 B2
(45) Date of Patent: Feb. 22, 2022

(54) DRIVE DEVICE AND DRIVE METHOD FOR DISPLAY PANEL, AND DISPLAY DEVICE

(71) Applicants: BOE TECHNOLOGY GROUP CO., LTD., Beijing (CN); Chongqing BOE Optoelectronics Technology Co., Ltd., Chongqing (CN)

(72) Inventor: Yang Liu, Beijing (CN)

(73) Assignees: BOE Technology Group Co., Ltd., Beijing (CN); Chongqing BOE Optoelectronics Technology Co., Ltd., Chongqing (CN)

( * ) Notice: Subject to any disclaimer, the term of this patent is extended or adjusted under 35 U.S.C. 154(b) by 396 days.

(21) Appl. No.: 16/309,846

(22) PCT Filed: Mar. 11, 2018

(86) PCT No.: PCT/CN2018/078648

§ 371 (c)(1),
(2) Date: Dec. 13, 2018

(87) PCT Pub. No.: WO2019/007098

PCT Pub. Date: Jan. 10, 2019

(65) Prior Publication Data

US 2021/0104190 A1 Apr. 8, 2021

(30) Foreign Application Priority Data

Jul. 3, 2017 (CN) ..... 201710534669.2

(51) Int. Cl.
*G09G 3/36* (2006.01)
*G09G 3/20* (2006.01)

(52) U.S. Cl.
CPC ..... *G09G 3/20* (2013.01); *G09G 2300/0809* (2013.01); *G09G 2320/02* (2013.01)

(58) Field of Classification Search
CPC .... G02F 1/13306; G02F 1/1368; G06F 30/20; G06F 30/392; G09G 3/3648;
(Continued)

(56) References Cited

U.S. PATENT DOCUMENTS 7,123,234 B2 * 10/2006 Moon ..... G02F 1/13452 345/98
9,183,772 B2 11/2015 Tsuchi
(Continued)

FOREIGN PATENT DOCUMENTS

CN 103745698 A 4/2014
CN 104392688 A 3/2015
(Continued)

OTHER PUBLICATIONS

International Search Report and Written Opinion dated May 22, 2018, from application No. PCT/CN2018/078648.

*Primary Examiner* — Lunyi Lao
*Assistant Examiner* — Jarurat Suteerawongsa
(74) *Attorney, Agent, or Firm* — Arch & Lake LLP

(57) ABSTRACT

The present disclosure relates to a drive device and a drive method of a display panel, and a display device. The drive device includes a driving unit configured to output a drive signal for driving a sub-pixel. The drive device includes a compensating unit coupled to the driving unit and a fanout line of a fanout region. The drive device is configured to compensate an impedance of the fanout line based on a reference impedance and the drive signal. The fanout region includes a plurality of fanout lines, and the reference impedance is a maximum impedance among the impedances of the plurality of fanout lines or an impedance greater than the maximum impedance.

8 Claims, 4 Drawing Sheets

| | R1 | R2 | ... | Rn-1 | Rn |
|---|---|---|---|---|---|
| Vs | Vs1 | Vs2 | ... | Vs(n-1) | Vsn |
| Vg=(Rm-Rx)*β/α+Vs | Vg1 | Vg2 | ... | Vg(n-1) | Vgn |

(58) Field of Classification Search
CPC ..... G09G 1/1368; G09G 3/36; G09G 2320/0242; G09G 2320/0223; G09G 3/20; G09G 2300/0809; G09G 2320/02
See application file for complete search history.

(56) References Cited

U.S. PATENT DOCUMENTS

| | | | | |
|---|---|---|---|---|
| 9,256,087 | B2 | 2/2016 | Wu | |
| 9,934,717 | B2 | 4/2018 | Zheng et al. | |
| 2006/0114216 | A1* | 6/2006 | Shim | G09G 3/3677 345/100 |
| 2012/0081410 | A1* | 4/2012 | Yeo | G09G 3/2092 345/690 |
| 2012/0306826 | A1 | 12/2012 | Tsuchi | |
| 2013/0120344 | A1* | 5/2013 | Liao | G06F 3/041 345/212 |
| 2015/0177546 | A1 | 6/2015 | Wu | |
| 2016/0027355 | A1 | 1/2016 | Tsuchi | |
| 2016/0343292 | A1 | 11/2016 | Zheng et al. | |
| 2017/0154599 | A1 | 6/2017 | Huang et al. | |

FOREIGN PATENT DOCUMENTS

| | | | |
|---|---|---|---|
| CN | 104835473 | A | 8/2015 |
| CN | 106816142 | A | 6/2017 |
| CN | 107248388 | A | 10/2017 |
| GB | 2 536 587 | A | 9/2016 |
| KR | 20060040509 | A | 5/2006 |
| KR | 100674919 | B1 | 1/2007 |

* cited by examiner

| | R1 | R2 | ... | Rn-1 | Rn |
|---|---|---|---|---|---|
| Vs | Vs1 | Vs2 | ... | Vs(n-1) | Vsn |
| Vg=(Rm-Rx)*β/α+Vs | Vg1 | Vg2 | ... | Vg(n-1) | Vgn |

DRIVE DEVICE AND DRIVE METHOD FOR DISPLAY PANEL, AND DISPLAY DEVICE

CROSS-REFERENCE TO RELATED APPLICATIONS

This application is based upon International Application No. PCT/CN2018/078648, filed on Mar. 11, 2018, which claims the priority to the Chinese Patent Application No. 201710534669.2 entitled "DRIVE DEVICE AND DRIVE METHOD FOR DISPLAY PANEL, AND DISPLAY DEVICE" filed on Jul. 3, 2017, the entire content of which is incorporated herein by reference.

TECHNICAL FIELD

The present disclosure relates to the field of display technologies, and more particularly, to a drive device and a drive method for a display panel, and a display device.

BACKGROUND

Existing display panel mainly includes liquid crystal display panels, light emitting diode (LED) display panels, and organic light-emitting diode (OLED) display panels. These display panels need driving units to provide drive signals to drive the display panels to display.

In conventional display devices, locations of wires of drive circuits in display panels generally have an effect on display picture quality.

It is to be noted that the above information disclosed in this Background section is only for enhancement of understanding of the background of the present disclosure and therefore it may contain information that does not form the prior art that is already known to a person of ordinary skill in the art.

SUMMARY

Arrangements of the present disclosure relate to a drive device and a drive method for a display panel, and a display device.

According to an aspect of the present disclosure, there is provided a drive device for a display panel. The drive device includes a driving unit configured to output a drive signal for driving a sub-pixel. The drive device includes a compensating unit coupled to the driving unit and a fanout line of a fanout region. The compensating circuit is configured to compensate an impedance of the fanout line based on a reference impedance and the drive signal. The fanout region includes a plurality of fanout lines. The reference impedance is a maximum impedance among the impedances of the plurality of fanout lines or an impedance greater than the maximum impedance.

In an exemplary arrangement of the present disclosure, the compensating unit includes a transistor having a first terminal, a second terminal and a control terminal. The control terminal of the transistor is configured to receive a compensation signal, the first terminal of the transistor is coupled to the driving unit to receive the drive signal, and the second terminal of the transistor is coupled to the fanout line.

In an exemplary arrangement of the present disclosure, one or more transistors are coupled between the driving unit and each of the plurality of fanout line of the fanout region.

In an exemplary arrangement of the present disclosure, when one transistor is coupled between the driving unit and the fanout line of the fanout region, a voltage of the compensation signal applied to the control terminal of the transistor is calculated based on a formula shown below:

$$Vg=(Rm-Rx)*\beta/\alpha+Vs$$

In the above formula, Vg represents the voltage of the compensation signal, Rm represents the maximum impedance among the impedances of the plurality of fanout lines, Rx represents the impedance of the $x^{th}$ fanout line, Vs represents a source voltage, $\alpha$ represents a carrier mobility, and $\beta$ represents an amplification factor of the transistor.

In an exemplary arrangement of the present disclosure, when a plurality of transistors are coupled between the driving unit and the fanout line of the fanout region, the plurality of transistors are coupled in parallel, and a voltage of the compensation signal applied to the control terminal of each transistor among the plurality of transistors is calculated based on a formula shown below:

$$Vg=(Rm-Rx)*N\beta/\alpha+Vs$$

In the above formula, Vg represents the voltage of the compensation signal, Rm represents the maximum impedance among the impedances of the plurality of fanout lines, Rx represents the impedance of the $x^{th}$ fanout line, Vs represents a source voltage, N represents the number of the plurality of transistors coupled in parallel, $\alpha$ represents a carrier mobility, and $\beta$ represents an amplification factor of the transistor.

In an exemplary arrangement of the present disclosure, the compensating unit further includes a compensating circuit, coupled to the control terminal of the transistor. The compensating circuit is configured to obtain the compensation signal corresponding to the drive signal based on the reference impedance, the drive signal and a matched impedance computation table of a register, and output the compensation signal to the control terminal of the transistor.

In an exemplary arrangement of the present disclosure, the compensating circuit includes a voltage-boosting circuit configured to generate a maximum voltage among voltages of a plurality of compensation signals corresponding to the plurality of fanout lines. The compensating circuit includes a distributing circuit configured to generate, based on the maximum voltage, the compensation signals distributed to respective transistors corresponding to the plurality of fanout lines.

According to an aspect of the present disclosure, there is provided a display device. The display device includes the drive device according to any one of the above arrangements.

According to an aspect of the present disclosure, there is provided a drive method for a display panel. The method includes. generating a drive signal for driving a sub-pixel. The method includes compensating an impedance of a fanout line coupled to the sub-pixel based on a reference impedance and the drive signal. The reference impedance is a maximum impedance among impedances of the plurality of fanout lines or an impedance greater than the maximum impedance. The method includes outputting the drive signal to the sub-pixel.

In an exemplary arrangement of the present disclosure, compensating the impedance of the fanout line coupled to the sub-pixel based on the reference impedance and the drive signal includes compensating the impedance of the fanout line coupled to the sub-pixel through a transistor based on the reference impedance and the drive signal.

In an exemplary arrangement of the present disclosure, compensating the impedance of the fanout line coupled to the sub-pixel through a transistor based on the reference impedance and the drive signal includes obtaining the compensation signal corresponding to the drive signal based on the reference impedance, the drive signal and a matched impedance computation table of a register. Further, such an operation includes outputting the compensation signal to the control terminal of the transistor to compensate the impedance of the fanout line coupled to the sub-pixel.

It should be understood that the above general description and the detailed description below are merely exemplary and explanatory, and do not limit the present disclosure.

BRIEF DESCRIPTION OF THE DRAWINGS

The accompanying drawings herein are incorporated in and constitute a part of this specification, illustrate arrangements conforming to the present disclosure and, together with the description, serve to explain the principles of the present disclosure. Apparently, the accompanying drawings in the following description show merely some arrangements of the present disclosure, and persons of ordinary skill in the art may still derive other drawings from these accompanying drawings without creative efforts.

DETAILED DESCRIPTION

Figure 1:
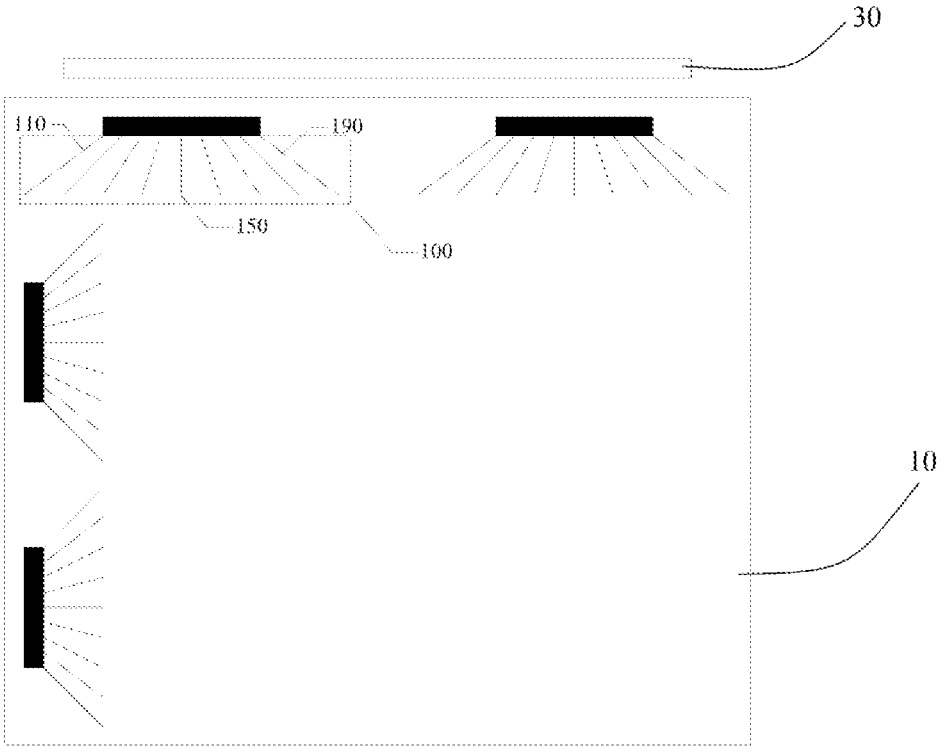
FIG. 1 illustrates a schematic diagram of fanout lines of a fanout region in a display device according to a technical solution.

The exemplary arrangement will now be described more fully with reference to the accompanying drawings. However, the exemplary arrangements can be implemented in a variety of forms and should not be construed as limited to the arrangements set forth herein. Rather, the arrangements are provided so that the present disclosure will be thorough and complete and will fully convey the concepts of exemplary arrangements to those skilled in the art. The features, structures, or characteristics described may be combined in one or more arrangements in any suitable manner. In the following description, numerous specific details are provided to give a full understanding of the arrangements of the present disclosure. Those skilled in the art will recognize, however, that the technical solution of the present disclosure may be practiced without one or more of the specific details described, or that other methods, components, materials, etc. may be employed. In other instances, well-known technical solutions are not shown or described in detail to avoid obscuring aspects of the present disclosure.

In addition, the accompanying drawings are merely exemplary illustration of the present disclosure, and are not necessarily drawn to scale. The same reference numerals in the drawings denote the same or similar parts, and thus repeated description thereof will be omitted. Some block diagrams shown in the figures are functional entities and not necessarily to be corresponding to a physically or logically individual entities. These functional entities may be implemented in software form, or implemented in one or more hardware modules or integrated circuits, or implemented in different networks and/or processor apparatuses and/or microcontroller apparatuses.

Data outputted from a drive circuit 30 are generally transmitted to each sub-pixel in a fan-shaped way, referring to FIG. 1. However, this fan-shaped output way causes different lengths from an output pin of the drive circuit 30 to fanout lines of each row of sub-pixels, such that a plurality of fanout lines (such as the fanout line 110 to the fanout line 190) of a fanout region 100 have inconsistent impedances, thus causing differences of signals of data outputted from the drive circuit 30 to each row of sub-pixels. The differences may cause a problem such as block in the display panel 10, which has a negative effect on display picture quality.

Figure 2:
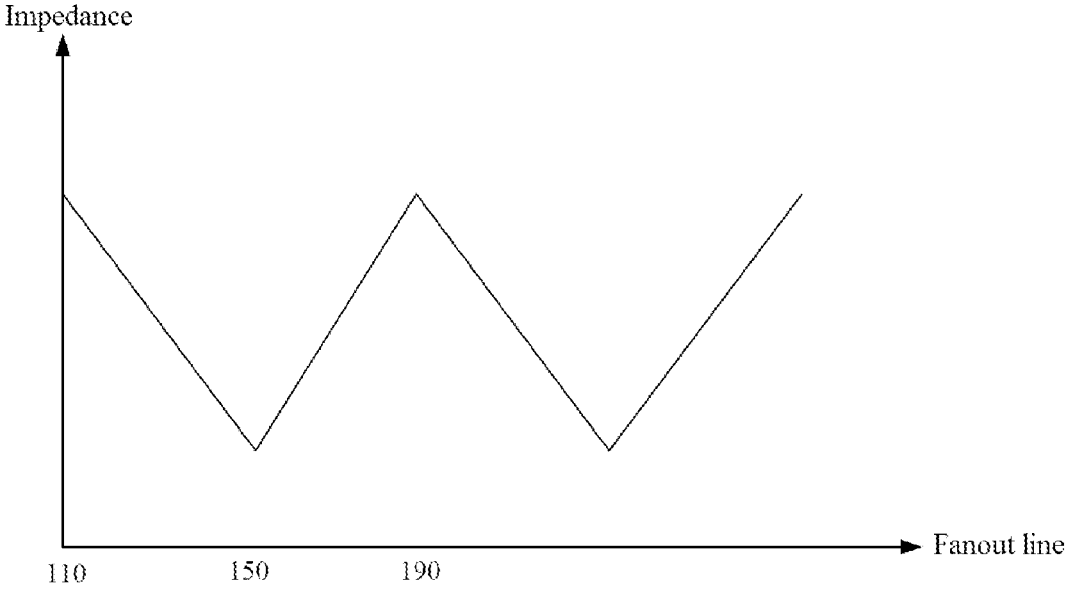
FIG. 2 schematically illustrates a distribution diagram of a fanout impedance of each fanout line as shown in FIG. 1.

Data outputted from the drive circuit 30 of the display device are generally transmitted to each sub-pixel in a fan-shaped way, which may cause inconsistent impedances of the plurality of fanout lines of the fanout region. Referring to FIG. 2, among the fanout lines 110-190 as shown in FIG. 1, the fanout line 110 is longer, and thus the fanout line 110 has a larger impedance; and fanout line 150 is shorter, and thus the fanout line 150 has a smaller impedance. Inconsistent impedances of the fanout lines may cause differences of signals of data outputted from the drive circuit 30 to each row of sub-pixels.

In another aspect, to enhance a cutting efficiency in practical production, it is required to reduce the distance from an effective display region to an edge of the display panel, which may increase, to some extent, differences in the fanout impedances of the fanout lines. To reduce the differences in the fanout impedances, when wires are arranged on the display panel, impedances of the fanout lines are ensured to be matched as much as possible by using the fanout lines having different line widths. However, this technical solution cannot completely eliminate the differences in the fanout impedances.

Figure 3:
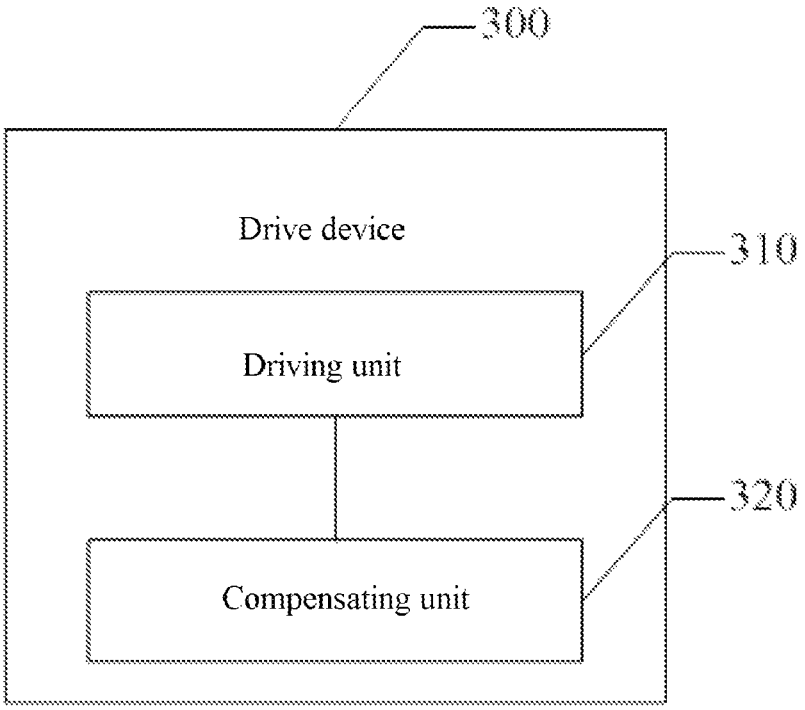
FIG. 3 illustrates a schematic diagram of a drive device according to an exemplary arrangement of the present disclosure.

In this exemplary arrangement, a drive device is first provided. Referring to FIG. 3, the drive device 300 may include: a driving unit 310 and a compensating unit 320.

The driving unit 310 is configured to output a drive signal for driving a sub-pixel.

The compensating unit 320 is coupled to the driving unit 310 and a fanout line of a fanout region and is configured to compensate an impedance of the fanout line based on a reference impedance and the drive signal. The fanout region includes a plurality of fanout lines, and the reference impedance is a maximum impedance among the impedances of the plurality of fanout lines or an impedance greater than the maximum impedance.

According to the drive device in this exemplary arrangement, impedances of fanout lines coupled to sub-pixels are compensated based on the reference impedance and the drive signal, such that negative effects of differences in the impedances of the fanout lines on the drive signals outputted to the sub-pixels may be minimized, and thus picture display quality can be improved. Furthermore, the impedances of the fanout lines may be compensated based on the reference impedance and the drive signal via the compensating unit.

Therefore, in the design of the display panel, fanout lines having different impedances may be employed to minimize the distance from an effective display region to an edge of the display panel.

The drive device 300 in this exemplary arrangement will be described in detail below.

In this exemplary arrangement, the driving unit 310 may include a source driver and/or a gate driver. The source driver is configured to generate a data driving signal, and the gate driver is configured to generate a control drive signal. After the driving unit 310 outputs the drive signal for driving a sub-pixel, the drive signal may be transmitted to each sub-pixel via a fanout line of the fanout region. For the same row of sub-pixels, differences in impedances of respective fanout lines may be caused by inconsistent lengths of respective fanout lines, such that driven by the same drive signal, different sub-pixels may generate different display results, which is one of sources of various display defects.

Therefore, the fanout impedance of each fanout line needs to be compensated, such that negative effects of differences in the impedances of the fanout lines on the signals outputted to different sub-pixels may be minimized. In this exemplary arrangement, the impedances of the fanout lines are compensated by the compensating unit 320, such that the differences of the drive signals received by the same row of sub-pixels can be reduced.

Specifically, in this exemplary arrangement, the compensating unit 320 is coupled to the driving unit and a fanout line of the fanout region and is configured to compensate the impedance of the fanout line based on the reference impedance and the drive signal, such that the differences of the drive signals received by the same row of sub-pixels can be reduced. The fanout region includes a plurality of fanout lines coupled to different sub-pixels, and the reference impedance is a maximum impedance among impedances of the plurality of fanout lines or an impedance greater than the maximum impedance.

Figures 5, 6:
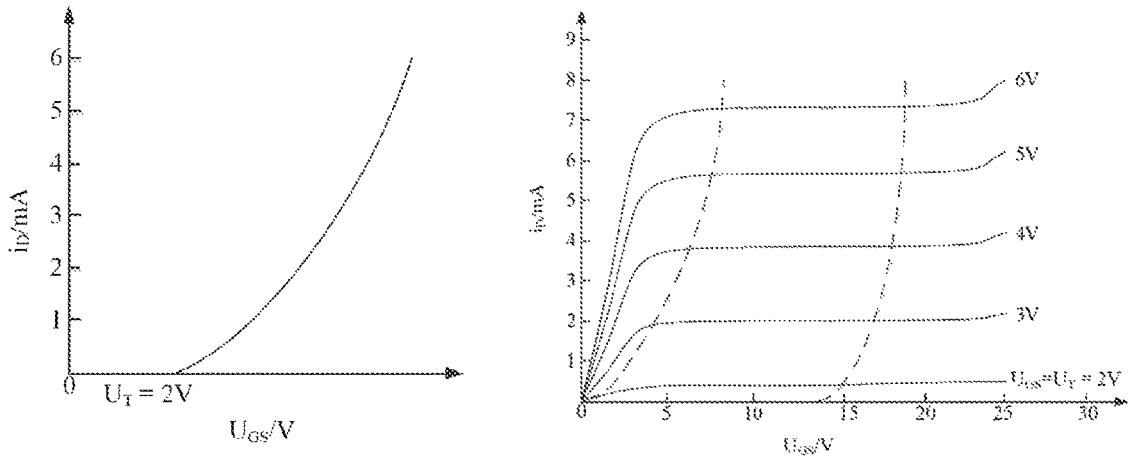
FIG. 5 schematically illustrates a relational graph between a turning-on impedance and a gate-source voltage of a transistor according to an exemplary arrangement of the present disclosure.
FIG. 6 schematically illustrates a matched impedance computation table according to an exemplary arrangement of the present disclosure.

Further, in this exemplary arrangement, the output terminal of the driving unit may be coupled to a transistor such as a metal oxide semiconductor field effect transistor (MOS transistor), as shown in FIG. 5. By using variation characteristics between a gate-source voltage and a source-drain turning-on impedance of the transistor, the impedance of each fanout line is compensated, such that impedances from the output terminal of the driving unit to respective sub-pixels are matched. In FIG. 5, the left chart shows a transfer characteristic curve of the MOS transistor, and the right chart shows an output characteristic curve of the MOS transistor. As can be seen from FIG. 5, the on resistance of the MOS transistor may be adjusted by adjusting the gate-source voltage of the MOS transistor, and the turn-on voltage of the MOS transistor is: UT=2V.

Figure 4:
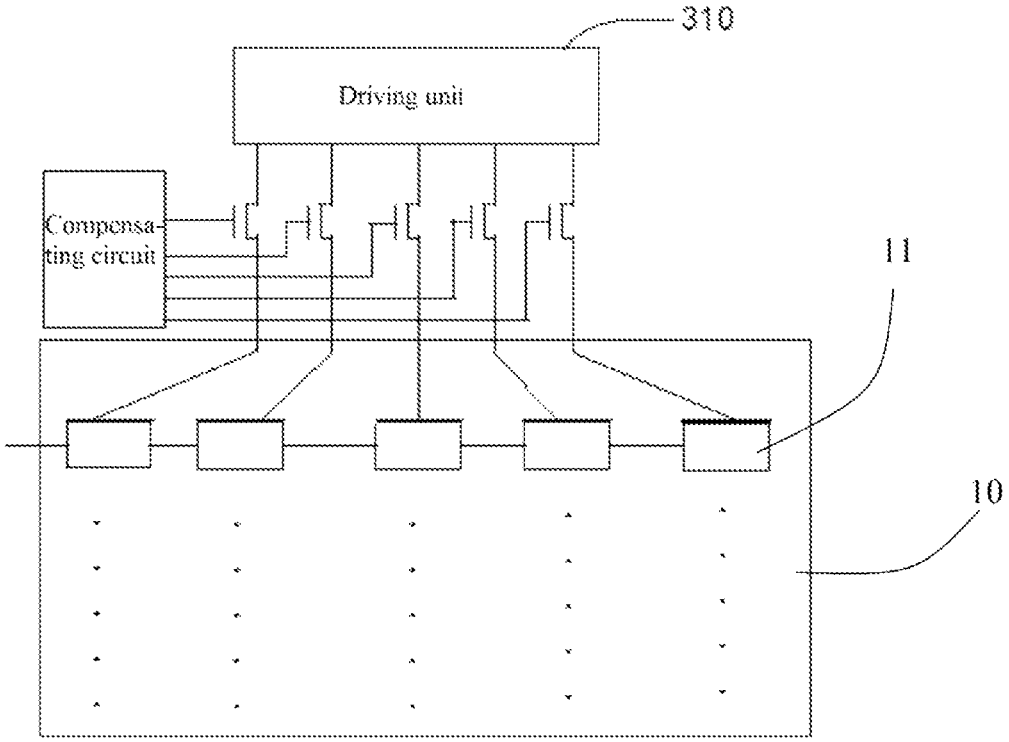
FIG. 4 illustrates a schematic diagram of a drive device according to another exemplary arrangement of the present disclosure.

Specifically, referring to FIG. 4, in this exemplary arrangement, the compensating unit 320 may include a transistor, which has a first terminal such as a source, a second terminal such as a drain, and a control terminal such as a gate. The control terminal of the transistor is configured to receive a compensation signal, the first terminal such as the source may be coupled to the driving unit 310 to receive the drive signal, and the second terminal such as the drain may be coupled to the fanout line of the fanout region. FIG. 4 illustrates that one transistor is coupled between the driving unit 310 and each fanout line of the fanout region. Nevertheless, the present disclosure is not limited thereto. For example, in the case that the minimum turning-on impedance of the MOS transistor is greater than the impedance of the fanout line required to be compensated, a plurality of parallel-coupled transistors may be coupled between the driving unit 310 and a fanout line of the fanout region. In this exemplary arrangement, the compensation signal required for the control terminal of the transistor may be adjusted based on the reference impedance and the drive signal to compensate the impedances of fanout lines coupled to the sub-pixels 11, such that negative effects of differences in the impedances of the fanout lines on the drive signals outputted to different sub-pixels 11 may be minimized.

Further, in this exemplary arrangement, referring to FIG. 4, fanout impedance data (or fanout impedance data actually measured in EN/mass production) of each fanout line in mask design may be captured to find out the maximum fanout impedance value Rm of respective fanout lines, the impedance of each fanout line required to be compensated with respect to the maximum fanout impedance value Rm is calculated shown below:

$$Rd=Rm-Rx \quad (1)$$

In formula (1), x=1, 2, 3 . . . n, n is the total number of fanout lines, Rx represents the fanout impedance of the $x^{th}$ fanout line, and Rd represents a differential between the fanout impedance of the $x^{th}$ fanout line and the maximum fanout impedance value Rm.

In this exemplary arrangement, the impedance of each fanout line may be compensated based on a characteristic relation between the gate-source voltage difference and the source-drain turning-on impedance Rv of the MOS transistor, such that the turning-on impedance Rv of the MOS transistor or the turning-on impedance of a plurality of parallel-coupled MOS transistors is equal to the impedance Rd required to be compensated. The characteristic relation is shown below:

$$Rv=\alpha*(Vg-Vs)/\beta \quad (2)$$

In formula (2), Vg represents a gate voltage, Vs represents a source voltage, α represents a carrier mobility, β represents an amplification coefficient of the MOS transistor, and Rv represents a turning-on resistance of the MOS transistor.

Further, in this exemplary arrangement, a voltage value of the source voltage Vs is processed and then outputted to the driving unit after a timing controller Tcon receives a signal of a front-end system video card. Therefore, when one transistor is coupled between the driving unit 310 and a fanout line of the fanout region, a formula for calculating the matched resistance Rd required to be compensated and the turning-on resistance Rv is written into a matched resistance calculation table (referring to FIG. 6, Rv=Rd=Rm−Rx) of a preset register. Every time the front-end source voltage Vs signal is received, a calculation is carried out based on the matched resistance calculation table, such that it may be calculated the gate voltage Vg required to be applied to the gate of one transistor coupled between the driving unit 310 and the fanout line of the fanout region. The formula for calculating Vg is shown below:

$$Vg=(Rm-Rx)*\beta/\alpha+Vs \quad (3).$$

Similarly, when a plurality of parallel-coupled transistors are coupled between the driving unit 310 and a fanout line of the fanout region, the impedance required to be compensated is a parallel impedance of the plurality of transistors, i.e., $$Rd=Rm-Rx=N*Rv \quad (4)$$

In formula (4), N represents the number of the plurality of parallel-coupled transistors, and Rv represents the resistance of each transistor of the plurality of parallel-coupled transistors.

Therefore, by substituting Rv into Formula (2), it may be obtained the voltage of a compensation signal applied to the control terminal of each transistor of the plurality of parallel-coupled transistors to compensate the impedance of a fanout line when the plurality of parallel-coupled transistors are coupled between the driving unit 310 and the fanout line of the fanout region, i.e., $$Vg=(Rm-Rx)*N\beta/\alpha+Vs \quad (5).$$

As shown in FIG. 4, in this exemplary arrangement, the compensating unit 320 also may be a compensating circuit. The compensating circuit is coupled to the control terminal of the transistor and is configured to obtain a compensation signal corresponding to the drive signal based on the reference impedance, the drive signal, and the matched resistance calculation table of the preset register, and output the compensation signal to the control terminal of the transistor.

According to some arrangements, the compensating circuit may include a voltage-boosting circuit, which is configured to generate a maximum voltage among voltages of a plurality of compensation signals corresponding to the plurality of fanout lines, i.e., to generate the maximum voltage Vg(max) among voltages of the compensation signals applied to respective transistors included in the driving unit 320. According to some arrangements, the compensating circuit may further include a distributing circuit, which is configured to generate, based on the maximum voltage, the compensation signals distributed to respective transistors corresponding to the plurality of fanout lines. For example, the distributing circuit may divide the maximum voltage Vg(max) generated by the voltage-boosting circuit based on the voltage of the compensation signal of each transistor, and apply the divided voltage as the compensation signal to the control terminal of the transistor to compensate the corresponding fanout line.

The source voltage Vs may likely be approximate to an analog voltage or reference voltage AVDD. Therefore, according to some arrangements, the voltage-boosting circuit may be implemented by using a voltage-boosting circuit integrated into the drive circuit, or may be implemented by using a circuit having a voltage-boosting function outside the display panel, such that the analog voltage AVDD is boosted to the gate voltage Vg(max).

According to some arrangements, the distributing circuit may include a voltage dividing resistor. In this case, the maximum voltage Vg(max) may be divided by the voltage dividing resistor to respectively generate the compensation signal applied to the control terminal of each transistor.

Figure 7:
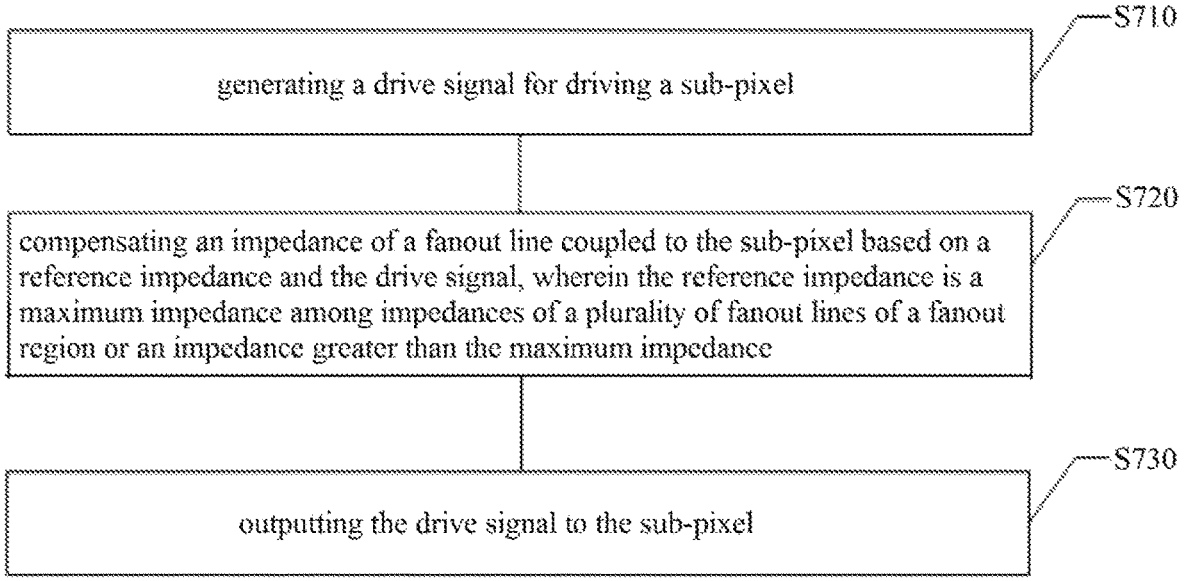
FIG. 7 schematically illustrates a schematic diagram of a drive method according to an exemplary arrangement of the present disclosure.

Furthermore, in this exemplary arrangement, there is further provided a drive method. As shown in FIG. 7, the drive method may include following blocks:

Block S710: generating a drive signal for driving a sub-pixel;

Block S720: compensating an impedance of a fanout line coupled to the sub-pixel based on a reference impedance and the drive signal. The reference impedance is a maximum impedance among impedances of a plurality of fanout lines of a fanout region or an impedance greater than the maximum impedance; and Block S730: outputting the drive signal to the sub-pixel.

According to the drive method in this exemplary arrangement, impedances of fanout lines coupled to sub-pixels are compensated based on the reference impedance and the drive signal, such that negative effects of differences in the impedances of the fanout lines on the drive signals outputted to the sub-pixels may be minimized, and thus picture display quality can be improved. Furthermore, the impedances of the fanout lines may be compensated based on the reference impedance and the drive signal. Therefore, in the design of the display panel, fanout lines having different impedances may be employed to minimize the distance from an effective display region to an edge of the display panel.

The drive method in this exemplary arrangement will be described in detail below.

In Block S710, a drive signal for driving a sub-pixel is generated.

In this exemplary arrangement, the drive signal for driving the sub-pixel is generated by a driving unit. The driving unit may include a source driver and/or a gate driver. The source driver is configured to generate a data driving signal, and the gate driver is configured to generate a control drive signal. After the driving unit outputs the drive signal for driving the sub-pixel, the drive signal may be transmitted to each sub-pixel via a fanout line of the fanout region.

In Block S720, an impedance of a fanout line coupled to the sub-pixel is compensated based on a reference impedance and the drive signal. The reference impedance is a maximum impedance among impedances of a plurality of fanout lines of the fanout region or an impedance greater than the maximum impedance.

In this exemplary arrangement, the impedance of the fanout line coupled to the sub-pixel is compensated based on the reference impedance and the drive signal, such that the differences of the drive signals received by the same row of sub-pixels can be reduced. The reference impedance is a maximum impedance among impedances of a plurality of fanout lines of the fanout region or an impedance greater than the maximum impedance.

Further, by using variation characteristics (as shown in FIG. 5) between a gate-source voltage and a source-drain turning-on impedance of the transistor, the impedance of each fanout line is compensated, such that respective impedances from the output terminal of the driving unit to the sub-pixels are matched. Therefore, in this exemplary arrangement, compensating an impedance of a fanout line coupled to the target sub-pixel based on a reference impedance and the drive signal may include: compensating the impedance of the fanout line coupled to the target sub-pixel through a transistor based on the reference impedance and the drive signal.

Further, a formula for calculating the impedance Rn required to be compensated and the turning-on resistance Rv is written into a matched resistance calculation table (referring to FIG. 6, Rv=Rn=Rm−Rx) of a register. Every time the front-end source voltage Vs signal is received, a calculation is carried out based on the matched resistance calculation table, such that the gate voltage of each transistor may be obtained. Therefore, in this exemplary arrangement, compensating the impedance of the fanout line coupled to the sub-pixel through a transistor based on the reference impedance and the drive signal includes: obtaining the compensation signal corresponding to the drive signal based on the reference impedance, the drive signal, and the matched resistance calculation table of the register; and outputting the compensation signal to the control terminal of the transistor to compensate the impedance of the fanout line coupled to the sub-pixel.

Moreover, as described above, the impedance of the same fanout line may be compensated by means of one transistor or a plurality of parallel-coupled transistors.

It is to be noted that blocks of the method in the present disclosure are described in a particular order in the accompanying drawings. However, this does not require or imply to execute these blocks necessarily according to the particular order, or this does not mean that the expected result cannot be implemented unless all the shown blocks are executed. Additionally or alternatively, some blocks may be omitted, a plurality of blocks may be combined into one block for execution, and/or one block may be decomposed into a plurality of blocks for execution.

Furthermore, in this exemplary arrangement, there is further provided a display device, which includes the drive device according to the above arrangements. The display device in this exemplary arrangement adopts the drive device, and thus at least has all the corresponding advantages of the drive device. In this exemplary arrangement, the display device may be: any product or component having a display function, such as an OLED panel, a mobile phone, a tablet computer, a TV set, a display, a notebook computer, a digital camera, and so on. However, the present disclosure is not limited thereto.

Other arrangements of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and arrangements be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. The scope of the present disclosure is only restricted by the appended claims.

What is claimed is:

1. A drive device for a display panel, comprising:

a driving unit, configured to output a drive signal for driving a sub-pixel;

a compensating unit, coupled to the driving unit and a first fanout line of a fanout region and configured to compensate an impedance of the first fanout line based on a reference impedance and the drive signal, wherein the fanout region comprises a plurality of fanout lines, and the reference impedance is a maximum impedance among the impedances of the plurality of fanout lines or an impedance greater than the maximum impedance, wherein the compensating unit comprises:

a transistor, having a first terminal, a second terminal and a control terminal, wherein the control terminal of the transistor is configured to receive a compensation signal, the first terminal of the transistor is coupled to the driving unit to receive the drive signal, and the second terminal of the transistor is coupled to the first fanout line, and wherein one or more transistors are coupled between the driving unit and each of the plurality of fanout lines of the fanout region, wherein:

when one transistor is coupled between the driving unit and the first fanout line of the fanout region, a voltage of the compensation signal applied to the control terminal of the transistor is calculated based on a formula as below:

$$Vg=(Rm-Rx)*\beta/\alpha+Vs;\text{ and}$$

when a plurality of transistors are coupled between the driving unit and the first fanout line of the fanout region, the plurality of transistors are coupled in parallel, and a voltage of the compensation signal applied to the control terminal of each transistor among the plurality of transistors is calculated based on a formula as below:

$$Vg=(Rm-Rx)*N\beta/\alpha+Vs,$$

wherein Vg represents the voltage of the compensation signal, Rm represents the maximum impedance among the impedances of the plurality of fanout lines, Rx represents an impedance of an $x^{th}$ fanout line of the plurality of fanout lines, Vs represents a source voltage, N represents a number of the plurality of transistors coupled in parallel, $\alpha$ represents a carrier mobility, and $\beta$ represents an amplification factor of the transistor.

2. The drive device according to claim 1, wherein the compensating unit further comprises:

a compensating circuit coupled to the control terminal of the transistor, the compensating circuit configured to obtain the compensation signal corresponding to the drive signal based on the reference impedance, the drive signal and a matched impedance computation table of a register, and output the compensation signal to the control terminal of the transistor.

3. The drive device according to claim 2, wherein the compensating circuit comprises:

a voltage-boosting circuit, configured to generate a maximum voltage among voltages of a plurality of compensation signals corresponding to the plurality of fanout lines; and a distributing circuit, configured to generate, based on the maximum voltage, the plurality of compensation signals distributed to respective transistors corresponding to the plurality of fanout lines.

4. A display device, comprising a drive device, wherein the drive device comprises:

a driving unit, configured to output a drive signal for driving a sub-pixel;

a compensating unit, coupled to the driving unit and a first fanout line of a fanout region, and configured to compensate an impedance of the first fanout line based on a reference impedance and the drive signal, wherein the fanout region comprises a plurality of fanout lines, and the reference impedance is a maximum impedance among the impedances of the plurality of fanout lines or an impedance greater than the maximum impedance, wherein the compensating unit comprises:

a transistor, having a first terminal, a second terminal and a control terminal, wherein the control terminal of the transistor is configured to receive a compensation signal, the first terminal of the transistor is coupled to the driving unit to receive the drive signal, and the second terminal of the transistor is coupled to the first fanout line, and wherein one or more transistors are coupled between the driving unit and each of the plurality of fanout lines of the fanout region, wherein:

when one transistor is coupled between the driving unit and the first fanout line of the fanout region, a voltage of the compensation signal applied to the control terminal of the transistor is calculated based on a formula as below:

$$Vg=(Rm-Rx)*\beta/\alpha+Vs;\text{ and}$$

when a plurality of transistors are coupled between the driving unit and the first fanout line of the fanout region, the plurality of transistors are coupled in parallel, and a voltage of the compensation signal applied to the control terminal of each transistor among the plurality of transistors is calculated based on a formula as below:

$$Vg=(Rm-Rx)*N\beta/\alpha+Vs,$$

wherein Vg represents the voltage of the compensation signal, Rm represents the maximum impedance among the impedances of the plurality of fanout lines, Rx represents an impedance of an $x^{th}$ fanout line of the plurality of fanout lines, Vs represents a source voltage, N represents a number of the plurality of transistors coupled in parallel, α represents a carrier mobility, and β represents an amplification factor of the transistor.

5. The display device according to claim 4, wherein the compensating unit further comprises:

a compensating circuit coupled to the control terminal of the transistor, the compensating circuit configured to obtain the compensation signal corresponding to the drive signal based on the reference impedance, the drive signal and a matched impedance computation table of a register, and output the compensation signal to the control terminal of the transistor.

6. The display device according to claim 5, wherein the compensating circuit comprises:

a voltage-boosting circuit, configured to generate a maximum voltage among voltages of a plurality of compensation signals corresponding to the plurality of fanout lines; and a distributing circuit, configured to generate, based on the maximum voltage, the compensation signals distributed to respective transistors corresponding to the plurality of fanout lines.

7. A drive method for a display panel, comprising:

generating a drive signal from a driving unit for driving a sub-pixel;

compensating an impedance of the first fanout line coupled to the sub-pixel based on a reference impedance through one transistor or a plurality of parallel-coupled transistors based on reference impedance and drive signal, and the drive signal, wherein the reference impedance is a maximum impedance among impedances of a plurality of fanout lines of a fanout region or an impedance greater than the maximum impedance;

outputting the drive signal to the sub-pixel, wherein compensating an impedance of a first fanout line coupled to the sub-pixel based on a reference impedance and the drive signal comprises:

compensating the impedance of the first fanout line coupled to the sub-pixel through a transistor of the compensating unit based on the reference impedance and the drive signal, wherein the transistor has a first terminal, a second terminal and a control terminal, the control terminal of the transistor is configured to receive a compensation signal, the first terminal of the transistor is coupled to the driving unit to receive the drive signal, and the second terminal of the transistor is coupled to the first fanout line wherein one or more transistors are coupled between the driving unit and each of the plurality of fanout lines of the fanout region, wherein:

when one transistor is coupled between the driving unit and the first fanout line of the fanout region, a voltage of the compensation signal applied to the control terminal of the transistor is calculated based on a formula as below:

$$Vg=(Rm-Rx)*\beta/\alpha+Vs;\text{ and}$$

when a plurality of transistors are coupled between the driving unit and the first fanout line of the fanout region, the plurality of transistors are coupled in parallel, and a voltage of the compensation signal applied to the control terminal of each transistor among the plurality of transistors is calculated based on a formula as below:

$$Vg=(Rm-Rx)*N\beta/\alpha+Vs,$$

wherein Vg represents the voltage of the compensation signal, Rm represents the maximum impedance among the impedances of the plurality of fanout lines, Rx represents an impedance of an $x^{th}$ fanout line of the plurality of fanout lines, Vs represents a source voltage, N represents a number of the plurality of transistors coupled in parallel, α represents a carrier mobility, and β represents an amplification factor of the transistor.

8. The drive method according to claim 7, wherein compensating the impedance of the first fanout line coupled to the sub-pixel through a transistor based on the reference impedance and the drive signal comprises:

obtaining the compensation signal corresponding to the drive signal based on the reference impedance, the drive signal and a matched impedance computation table of a register; and outputting the compensation signal to the control terminal of the transistor to compensate the impedance of the first fanout line coupled to the sub-pixel.

* * * * *